US005653050A

United States Patent [19]

Hosaka et al.

[11] Patent Number: 5,653,050

[45] Date of Patent: Aug. 5, 1997

[54] CATALYTIC COMBUSTION IRON

[75] Inventors: Masato Hosaka, Osaka; Akira Maenishi, Ikeda; Jiro Suzuki, Nara; Haruo Ida, Kishiwada, all of Japan

[73] Assignee: Matsushita Electric Industrial Co., Ltd., Osaka, Japan

[21] Appl. No.: 468,837

[22] Filed: Jun. 6, 1995

[30] Foreign Application Priority Data

Jun. 6, 1994 [JP] Japan ..... 6-123741
Jun. 13, 1994 [JP] Japan ..... 6-130592

[51] Int. Cl.[6] ..... D06F 75/06

[52] U.S. Cl. ..... 38/86; 126/412

[58] Field of Search ..... 38/82, 83–87; 431/268, 329, 347, 255, 266, 344; 126/408, 409, 411, 412, 414, 401; 219/222

[56] References Cited

U.S. PATENT DOCUMENTS 4,571,863 2/1986 Freckleton et al. ..... 126/412 X
4,733,651 3/1988 Schawbel et al. ..... 126/408 X

FOREIGN PATENT DOCUMENTS 2144697 6/1987 Japan .
6098996 4/1994 Japan ..... 38/86
7000698 1/1995 Japan .

*Primary Examiner*—Ismael Izaguirre
*Attorney, Agent, or Firm*—Ratner & Prestia

[57] ABSTRACT

The present invention provides a catalytic combustion iron capable of further enhancing the stability of catalyst combustion.

The invention comprises a fuel tank for storing liquefied fuel gas, a nozzle for vaporizing and injecting liquefied gas in the fuel tank, a mixing device for mixing the fuel gas injected from the nozzle and air, a combustion chamber in which mixed gas is supplied, a catalyst installed in the combustion chamber, a water tank for storing the water for generating steam, a vaporizing chamber for vaporizing the water supplied from the water tank by the combustion heat generated by the catalyst, a base having steam pores for injecting the steam generated in the vaporizing chamber, an exhaust port provided at the downstream side of the combustion chamber and installed at the outer peripheral side of the base, and an exhaust passage formed between the exhaust port and the combustion chamber, wherein the exhaust passage is mounted above the base, the combustion chamber is mounted above the exhaust passage, the vaporizing chamber is mounted above the combustion chamber, and the mixing device and combustion chamber are coupled nearly at right angle.

24 Claims, 12 Drawing Sheets

CATALYTIC COMBUSTION IRON

BACKGROUND OF THE INVENTION

1. Field of the Invention

The present invention relates to a catalytic combustion iron for straightening wrinkles of clothes by making use of the heat obtained by catalytic combustion of liquefied fuel gas.

2. Description of the Prior Art

In this kind of catalytic combustion iron, hitherto, as disclosed in Japanese Laid-open Patent No. 62-144697, a fuel composed of flammable liquefied gas such as propane and butane is supplied from a nozzle having a control device to the catalyst to induce oxidation reaction on the catalyst surface, thereby generating combustion heat.

Removal of wrinkles of clothes which is the purpose of using the iron is realized by bringing the base heated by the combustion heat into contact with the object to be heated or the clothes.

Catalytic combustion progresses combustion reaction at a far lower temperature than flame combustion of fuel in contact with the catalyst surface. To conduct the combustion reaction on the catalyst surface to a perfection, the temperature of the catalyst itself must be maintained ever the intrinsic activation temperature.

However, when contacting with the clothes or other object to be heated to remove wrinkles of clothes, or when water is supplied into the vaporizing chamber for generating steam, if the temperature fluctuations in the combustion chamber are large, the combustion becomes unstable.

To start catalytic combustion, moreover, the catalyst temperature must be maintained at high temperature, over the intrinsic activation temperature. Accordingly, in the catalytic combustion iron, too, the catalyst is heated by heater or flame when starting to raise the catalyst temperature higher than the activation temperature, and then the fuel is supplied to the catalyst, thereby starting the catalytic combustion. In the event of heater disconnection of misfiring, however, the catalyst is not heated when starting, and if the fuel gas is supplied to the catalyst, catalytic combustion is not started. In this case, therefore, the fuel gas is directly discharged from the exhaust port which is intended to exhaust the combustion gas generated by catalytic combustion to outside of the catalytic combustion iron.

At this time, if a lighter or other flame is brought closer to the exhaust port, the outgoing fuel gas is ignited, and the flame may remain burning on the exhaust port.

It is hence a primary object of the invention to provide a catalytic combustion iron capable of solving the problems of the prior art, enhancing the stability of combustion more than in the prior art, and further excelling in safety.

SUMMARY OF THE INVENTION

A first aspect of the invention relates to a catalytic combustion iron comprising a fuel tank for storing liquefied fuel gas, a nozzle for vaporizing and injecting liquefied gas in the fuel tank, a mixing device for mixing the fuel gas injected from the nozzle and air, a combustion chamber for holding a catalyst and burning the mixed gas catalytically by using the catalyst, a base having an exhaust port for exhausting the combustion gas outside on the outer peripheral side, and an exhaust passage formed between the exhaust port and the combustion chamber outlet, wherein the exhaust passage is mounted above the base, and the combustion chamber is mounted above the exhaust passage.

According to the first aspect of the invention, for example, the fuel gas injected from the nozzle aspirates the surrounding air by the induction action of the gas flow to generate a mixed gas, which is supplied to the combustion chamber. The combustion chamber holds the catalysts, and burns the mixed gas by catalytic combustion by using the catalyst, and the base contacts with the heating object, and the exhaust passage is provided between the combustion chamber and the base, which allows to pass the combustion gas generated in catalytic combustion. In such catalytic combustion, because of combustion on the catalyst surface, the combustion temperature of the catalyst surface has a great effect on the combustion characteristic.

Since the exhaust passage is provided between the base which contacts with the heating object, and the combustion chamber, the lower part of the combustion chamber does not contact directly with the heating object, and hence effects of fluctuations of heating calories to the heating object are small, and fluctuations of catalyst temperature in the combustion chamber can be alleviated.

A second aspect of the invention relates to a catalytic combustion iron, further comprising a water tank for storing water for generating steam, a vaporizing chamber for generating steam by vaporizing the water supplied from the water tank by the combustion heat generated by the catalyst, and a base having steam pores for injecting the steam generated in the vaporizing chamber in the bottom surface, wherein the vaporizing chamber is mounted on the combustion chamber.

According to the second aspect of the invention, for example, the vaporizing chamber is provided above the combustion chamber, and the base is provided beneath the combustion chamber through the exhaust passage. Accordingly, for example, the combustion chamber lower part does not directly contact with the heating object, and effects of fluctuations of heating calories to the heating object are small. On the other hand, the upper part of the combustion chamber is connected to the vaporizing chamber, and it is susceptible to changes of vaporization amount in the vaporizing chamber, and the temperature of the catalyst surface is likely to change. In the lower part of the combustion chamber, however, since the combustion temperature is maintained high as mentioned above, the combustion heat in the lower part of the combustion chamber is supplied to the upper part of the combustion chamber as radiation. As a result, fluctuations of catalyst temperature in the upper part of the combustion chamber can be prevented, so that stable combustion may be realized.

A third aspect of the invention relates to a catalytic combustion iron, wherein the combustion chamber and exhaust passage are coupled so that the flowing direction of combustion gas flowing in the exhaust passage, generated in catalytic combustion, is substantially reverses to the flowing direction of the mixed gas flowing in the combustion chamber.

A fourth aspect of the invention relates to a catalytic combustion iron, wherein a gas flow velocity regulator for adjusting the flew velocity distribution of mixed gas to be uniform substantially, at least in the vertical direction in the combustion chamber, is provided between the mixing device and the combustion chamber inlet.

According to the fourth aspect of the invention, for example, since the gas flow velocity regulator is provided between the mixing chamber and combustion chamber, the flow velocity distribution of mixed gas in the vertical direction in the combustion chamber is substantially uniform, so that catalytic combustion in the combustion chamber is stabilized.

A fifth aspect of the invention relates to a catalytic combustion iron, wherein the mixing device and combustion chamber are coupled so that the configuration may be substantially orthogonal.

According to the fifth aspect of the invention, for example, the mixing device and combustion chamber are coupled nearly at right angle. By thus constituting, the flow velocity of the mixed gas supplied in the combustion chamber is small in the upper part of the combustion chamber in which a streamline small in radius of curvature flows, and large in the lower part of the combustion chamber in which a streamline large in radius of curvature flows. In addition, a stagnant region is formed in the upper part of the combustion chamber near the inlet of the combustion chamber where the radius of curvature is small, and the flow becomes slow, whereas in the lower part of the combustion chamber near the combustion chamber inlet where the radius of curvature is large, a centrifugal force acts and the mixed gas flows smoothly.

On the other hand, for example, since the upper part of the combustion chamber contacts with the vaporizing chamber, the combustion temperature tends to be lower, while the lower part of the combustion chamber contacts with the base through the exhaust passage and hence the combustion temperature is likely to be maintained high. Therefore, when the mixed gas is supplied into the combustion Chamber, the fluid resistance is small in the upper part of the combustion chamber where the temperature is low, and the fluid resistance is large in the lower part of the combustion chamber where the temperature is high. Hence, the mixed gas is likely to flow smoothly in the upper part of the combustion chamber, and by the synergistic effect of declining tendency of the combustion temperature, the catalytic reaction by the catalyst is not done actively. The mixed gas hardly flows in the lower part of the combustion chamber, and hence the mixed gas volume decreases, and the combustion decreases, and hence the radiation heat from the lower part of the combustion chamber also decreases, and thereby the temperature fluctuations in the upper part of the combustion chamber are likely to be large.

Therefore, the temperature difference of upper part and lower part of the combustion chamber and the flow resistance cancel each other, and the mixed gas flows uniformly in the combustion chamber. As a result, combustion becomes stable in the combustion chamber.

A sixth aspect of the invention relates to a catalytic combustion iron, wherein all or part of the mixed gas flowing in the exhaust passage is substantially continuously formed from the exhaust port to the outlet of the combustion chamber at the upstream side, and all or part of the continuously formed mixed gas has a flow velocity which is slower than a combustion speed of the mixed gas.

According to the sixth aspect of the invention, for example, it is constituted so that the flow velocity of the substantially continuously formed mixed gas flowing in the exhaust passage, may be lower than the combustion speed of the mixed gas.

In such constitution, for example, when a flame of a lighter or the like is brought closer to the exhaust port, the flame ignited on the mixed gas propagates to the upstream of the flow direction of the mixed gas because the combustion speed is faster than the mixed gas flow velocity. Accordingly, the flame is aspirated from the exhaust port, and propagates in the exhaust passage, and invades into the junction of the combustion chamber and exhaust passage this flame, the combustion chamber is heated, and the catalyst installed in the combustion chamber is also heated. Consequently, when the catalyst temperature reaches an active temperature, catalytic reaction on the catalyst surface starts, and fuel gas is not supplied into the flame in the exhaust passage, so that the flame in the exhaust passage is extinguished.

A seventh aspect of the invention relates to a catalytic combustion iron, wherein the passage sectional area of the exhaust passage is set wider than a specific area so that the flow velocity of all or part of the continuously formed mixed gas flowing in the exhaust passage may be slower than the combustion speed of the mixed gas.

According to the seventh aspect of the invention, for example, the passage sectional area of the exhaust passage is set larger than a specified area, so that the flow velocity of all or part of the continuously formed mixed gas flowing in the exhaust passage may be slower than the combustion speed of the mixed gas.

In this constitution, for example, when a flame of a lighter or the like is brought closer from the exhaust port, the flame ignited on the mixed gas propagates to the upstream of the flowing direction of the mixed gas because the combustion speed is faster than the flow velocity of the mixed gas.

An eighth aspect of the invention relates to a catalytic combustion iron, wherein a groove is formed from the exhaust port to the upstream side in the exhaust port so that the flow velocity of all or part of the continuously formed mixed gas flowing in the exhaust passage may be slower than the combustion speed of the mixed gas.

According to the eighth aspect of the invention, for example, a groove is formed from the exhaust port of the exhaust passage toward the upstream so that the flow velocity of all or part of the continuously formed mixed gas flowing in the exhaust passage may be slower than the combustion speed of the mixed gas.

In such constitution, for example, if ignited by a lighter or the like from the exhaust port, the flame propagates along the groove of the exhaust passage, and is aspirated into the exhaust passage.

A ninth aspect of the invention relates to a catalytic combustion iron, wherein a bending is formed in the exhaust passage near the exhaust port, and this bending is formed so that the flow velocity of the mixed gas at least in the vicinity of the bending may be slower than the combustion speed of the mixed gas.

According to the ninth aspect of the invention, for example, a bending is formed in the exhaust passage near the exhaust port, and this bending is formed so that the flow velocity of the mixed gas at least near the bending may be slower than the combustion speed of the mixed gas.

In such constitution, for example, when the exhaust passage is bent nearly at right angle near the exhaust port, the flow velocity of the mixed gas flowing in the exhaust passage is slow inside of the bending, and fast outside of the bending. Accordingly, if ignited by a lighter or the like from the exhaust port, the flame propagates in the slow flow velocity region inside of the bending, and is aspirated into the exhaust passage.

A tenth aspect of the invention relates to a catalytic combustion iron, wherein a flame retaining plate having multiple tiny pores is provided at the combustion chamber outlet, and the passage sectional area of the exhaust passage near the flame retaining plate is set smaller than the passage sectional area of the downstream side of the exhaust passage.

According to the tenth aspect of the invention, for example, the flame retaining plate having multiple tiny pores is provided at the combustion chamber outlet, and the passage sectional area of the exhaust passage near the flame retaining plate is set smaller than the passage sectional area of the downstream side of the exhaust passage.

In such constitution, for example, the flame propagating to the upstream side along the exhaust passage reaches the flame retaining plate and burns. Since the exhaust passage near the flame retaining plate is smaller in passage sectional area than the downstream side of the exhaust passage, a vortex is formed near the expanding place of the passage sectional area of the exhaust passage near the flame retaining plate, and the flame setting on the flame retaining plate is very stable. Hence, once aspirate, the flame is not moved again to the exhaust port, so that catalytic combustion is set about smoothly.

An eleventh aspect of the invention relates to a catalytic combustion iron, wherein all or part of the side wall of the exhaust passage is formed as partition between the exhaust passage and combustion chamber, and a communication hole that can be shielded by the portion held along the partition in the catalyst is provided in the partition.

According to the eleventh aspect of the invention, for example, all or part of the side wall of the exhaust passage is formed as partition between the exhaust passage and combustion chamber, and a communication hole that can be shielded by the portion held along the partition in the catalyst is provided in the partition.

In such constitution, for example, the flame propagating to the upstream side along the exhaust passage reaches the flame retaining plate and burns. Thus, the catalyst can be directly heated by the flame in the exhaust passage formed in this manner, so that transfer to catalytic combustion can be shortened.

A twelfth aspect of the invention relates to a catalytic combustion iron, wherein a flame retaining plate having multiple tiny pores is provided at the combustion chamber outlet, and this flame retaining plate is extended nearly to the communication hole along the wall of the exhaust passage.

According to the twelfth aspect of the invention, for example, a flame retaining plate having multiple tiny pores is provided at the combustion chamber outlet, and this flame retaining plate is extended nearly to the communication hole along the wall of the exhaust passage.

In such constitution, for example, the flame propagating to the upstream side along the exhaust passage reaches the flame retaining plate and burns. This flame is extended to the downstream side along the flame retaining plate, so that the flame securely reaches the communication hole, and thereby the catalyst temperature rises easily by the flame in the exhaust passage.

A thirteenth aspect of the invention relates to a catalytic combustion iron, wherein a flame retaining plate having multiple tiny pores is provided near the combustion chamber outlet in the exhaust passage, and the flame retaining plate is installed at such an angle that the mixed gas once passes through the flame retaining plate, and collides against the wall of the exhaust passage, and passes through the flame retaining plate again, so that the flame on the flame retaining plate may contact with the catalyst which shields the communication hole.

According to the thirteenth aspect of the invention, for example, a flame retaining plate having multiple tiny pores is provided near the combustion chamber outlet in the exhaust passage, and the flame retaining plate is installed at such an angle that the mixed gas once passes through the flame retaining plate, and collides against the wall of the exhaust passage, and passes through the flame retaining plate again, so that the flame on the flame retaining plate may contact with the catalyst which shields the communication hole.

In such constitution, for example, the flame propagating to the upstream side through the exhaust passage sets on stably on the flame retaining plate because there is a stagnant region of mixed gas accompanied by vortex near the flame retaining plate. Moreover, since the flame retaining plate is installed at specified angle, the setting flame easily reaches the communication hole pierced in the side of the exhaust passage, thereby shortening the transfer to catalytic combustion.

REFERENCE NUMERALS

Figure 1:
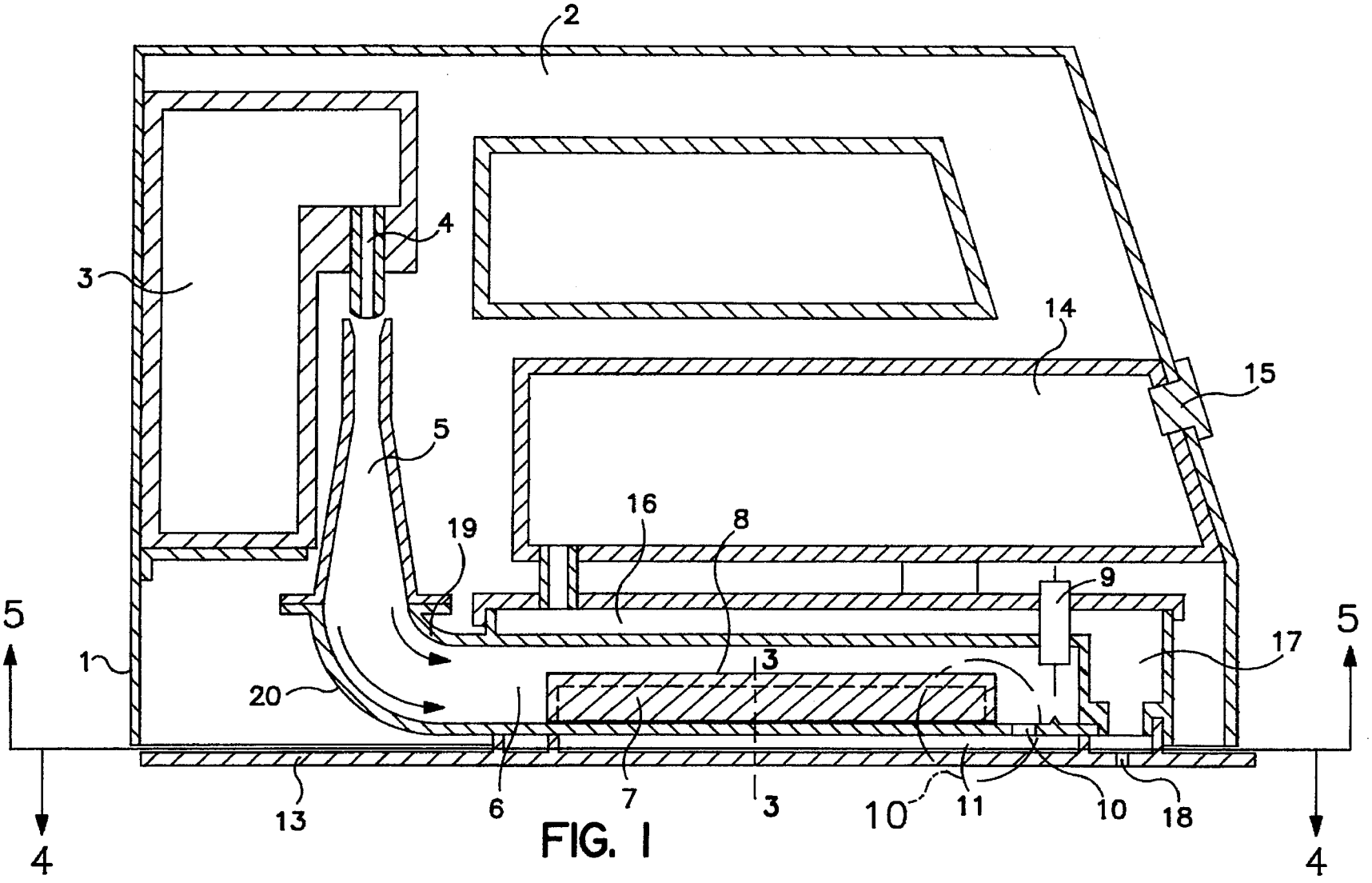
FIG. 1 is a vertical sectional view of a catalytic combustion iron according to an embodiment of the invention.

4 Nozzle
5 Mixing device
6 Combustion chamber
8 Catalyst
11 Exhaust passage
12 Exhaust port
13 Base
16 Vaporizing chamber
24 Groove
26, 34, 36 Flame retaining plates
31, 32 Communication holes

DESCRIPTION OF THE INVENTION

Referring now to the drawings, embodiments of the invention are described in detail below.

(Embodiment 1)

Figure 2:
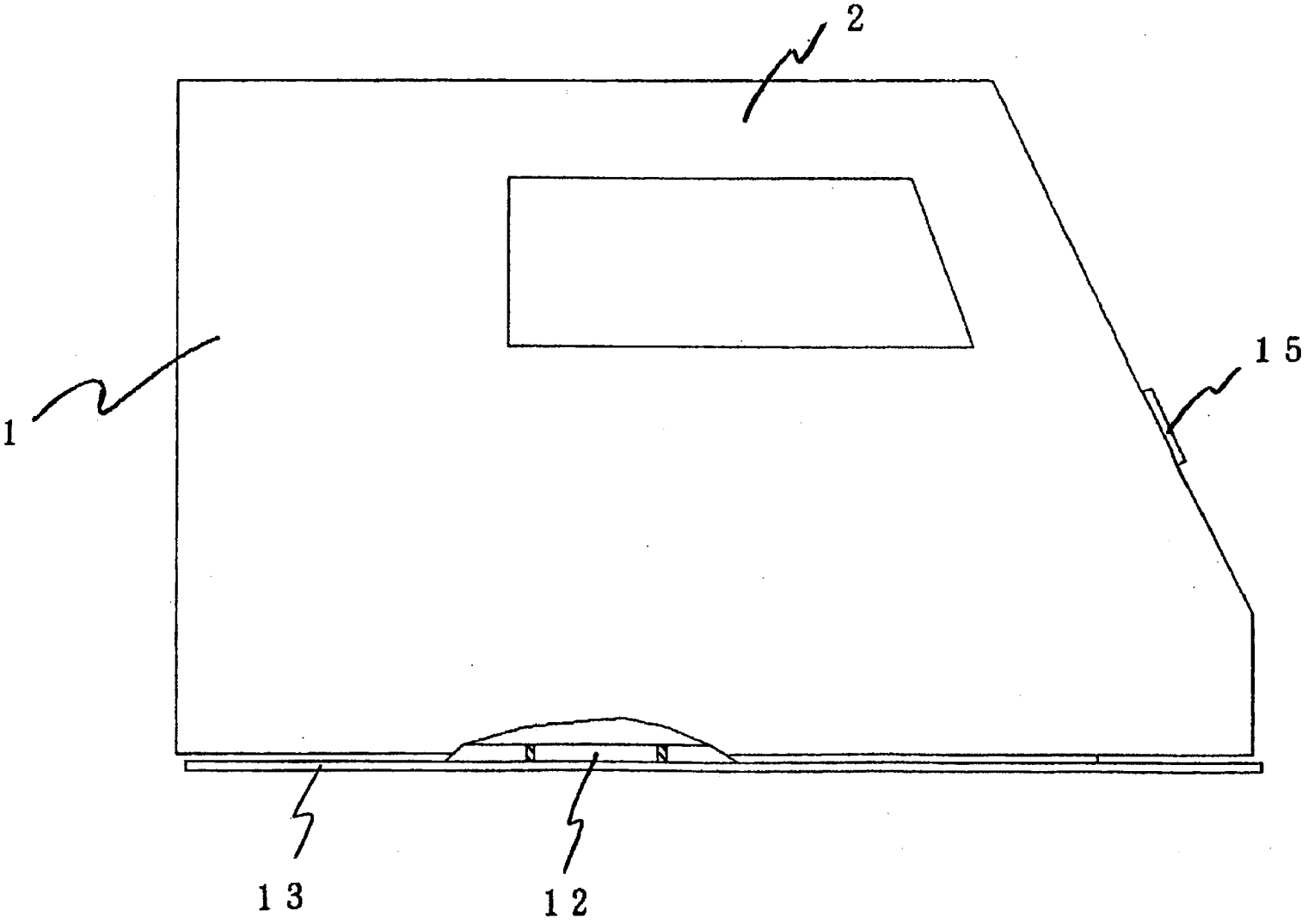
FIG. 2 is a front view of the catalytic combustion iron according to the embodiment of the invention.
Figure 3:
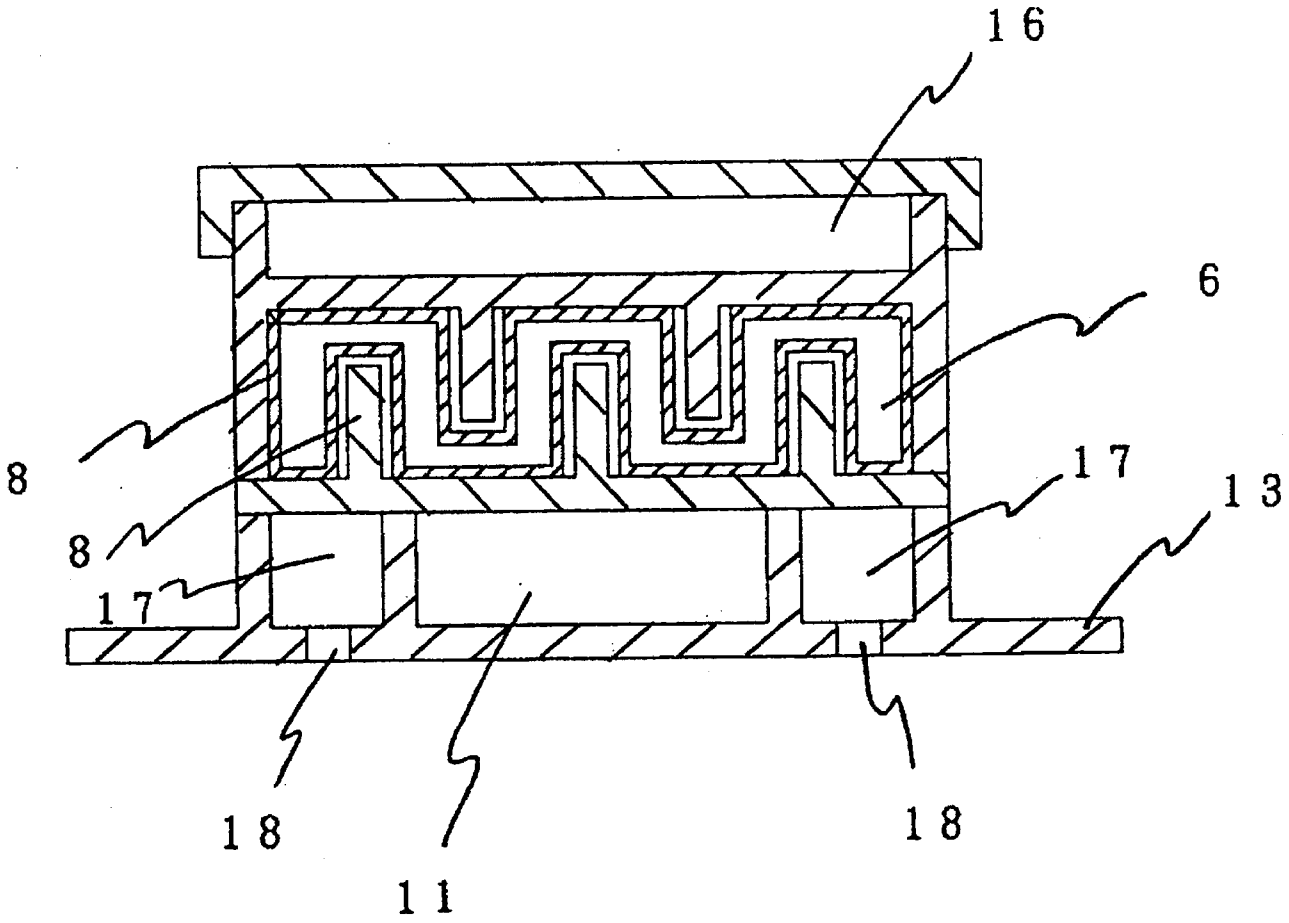
FIG. 3 is an a cross sectional view of the catalytic combustion iron according to the embodiment of the invention (taken along line 3—3 in FIG. 1).

FIG. 1 is a vertical sectional view of an embodiment of the invention, FIG. 2 is a front view of an embodiment of the invention, and FIG. 3 is a sectional view of line AA in FIG. 1. Reference numeral 1 denotes an iron main body having a handle 2, and 3 is a liquefied gas cylinder of propane, butane or the like. The gas cylinder 3 is provided with a nozzle 4 having a valve (not shown) capable of adjusting the injection amount, so that the flow rate of the fuel gas supplied from the gas cylinder 3 can be controlled. The fuel gas injected from the nozzle 4 aspirates the surrounding air by the induction action of the gas flow, and is mixed uniformly in a mixing device 5, and supplied into a combustion chamber 6. The combustion chamber 6 is a metal casing, and a plurality of fins 7 is provided therein almost parallel to the flow direction of the mixed gas, thereby increasing the surface area within the combustion chamber 6 without changing the size of the combustion chamber 6.

A lamellar catalyst 8 is provided in the combustion chamber 6 along the inner wall of the combustion chamber. The material held in the catalyst 8 is platinum metal, and metal oxide of nickel, cobalt, iron, manganese, chromium or the like, and what is particularly preferable is platinum metal such as platinum, palladium and rhodium.

The fuel gas is supplied from the nozzle 4 into the mixing device 5, and the air aspirated by induction to the injection force of the fuel gas and the fuel gas are mixed in the mixing device 5, and the mixed gas is supplied into the combustion chamber 6. At the opposite side of the mixed gas inlet of the combustion chamber 6, an ignition device 9 is provided, and by striking a spark from the front end plug of the ignition device 9, the mixed gas is ignited.

The catalyst 8 is heated by the flame formed at the downstream side of the catalyst 8, and When the temperature of the catalyst 8 reaches the active temperature, catalytic combustion begins on the surface of the catalyst 8, and mixed gas is no longer supplied onto the flame, and hence the flame is extinguished. Thereafter, the mixed gas supplied into the combustion chamber 6 is burnt in the entire catalyst 8 in the combustion chamber 6 by catalytic combustion.

The combustion gas departs from the combustion chamber outlet 10, passes through an exhaust passage 11, and is released to the atmosphere through an exhaust port Herein, the exhaust port 12 is provided on the outer side of the base 13 heated by the combustion heat generated in the combustion chamber 6, so that the exhaust port 12 may not be clogged by the heating object when ironing.

When the temperature of the combustion chamber 6 exceeds a set temperature, the valve provided in the nozzle 4 is closed to stop supply of the fuel gas, and when the temperature of the combustion chamber becomes less than the set temperature, the valve is opened again to start supply of fuel gas. The fuel gas supplied again is mixed with air in the mixing device 5, and flows into the combustion chamber 6. The mixed gas supplied into the combustion chamber 6 flows in the combustion chamber 6, and combustion begins to spread again.

The water for generating steam is stored in a water tank 14 provided above the combustion chamber 6. To supply water, a lid 15 is removed, and it is fed into the water tank 14. Above the combustion chamber 6 is installed a vaporizing chamber for generating steam by vaporizing the water supplied from the water tank 14 by combustion heat. The steam generated in the vaporizing chamber 16 passes through a steam passage 17, and is injected to the atmosphere through a plurality of steam holes 18 opened in a base 13.

In thus constituted catalytic combustion iron, the fuel gas injected from the nozzle 4 aspirates the surrounding air by the induction action of gas flow, and is mixed uniformly in the mixing device 5, and supplied into the combustion chamber 6. The mixed gas supplied in the combustion chamber 6 flows in the combustion chamber 6 and contacts with the lamellar catalyst 8 maintained at high temperature, thereby undergoing catalytic combustion. Because of burning on the surface of the catalyst 8, the combustion temperature on the surface of the catalyst 8 have a great effect on the combustion characteristics.

In this embodiment, the vaporizing chamber 16 is provided above the combustion chamber 6, and the base 13 is installed in the lower part of the combustion chamber 6 through the exhaust passage 12. Accordingly, when straightening the wrinkles of clothes, for example, if the base 13 contacts directly with the heating object such as clothes, there is the exhaust passage 11 of flow of combustion gas at high temperature between the base 13 and combustion chamber 6, the lower part of the combustion chamber 6 is less affected by fluctuations of heating calories on the heating object, and the combustion temperature can be easily maintained high in the lower part of the combustion chamber 6.

On the other hand, from the water tank 14, water is supplied intermittently into the vaporizing chamber 16, and the steam may be generated or not when ironing, and therefore the vaporization amount of water in the vaporizing chamber 16 varies significantly. Since the vaporizing chamber 16 is installed above the combustion chamber 6, the upper part of the combustion chamber 6 is affected by fluctuations of the vaporizing amount in the vaporizing chamber 16, and hence the temperature of the catalyst surface is likely to vary. While the vaporizing amount is small, the combustion temperature can be maintained high and there is no particular problem, but as the vaporizing amount increases, heat supply from the upper part of the combustion chamber 6 into the vaporizing chamber 16 increases, and the catalyst temperature tends to decline during combustion.

In the embodiment, however, since the combustion temperature is always kept high in the lower part of the combustion chamber 6, the combustion heat in the lower part of the combustion chamber 6 is supplied to the upper part of the combustion chamber 6 as radiation, and lowering of catalyst temperature in the upper part of the combustion chamber 6 is prevented, so that stable combustion is realized.

Incidentally, catalytic combustion starts after the fuel gas contacts with the catalyst surface, and therefore when the catalyst is installed along the flow direction of the mixed gas, the upstream part of the catalyst is higher in temperature than the downstream part. Considering the durability of the catalyst material, it is preferred that the temperature distribution of the catalyst be as uniform as possible.

In the embodiment, meanwhile, the combustion chamber 6 and exhaust port 12 are coupled through the exhaust passage 11 so that the combustion chamber outlet 10 and exhaust port 12 may be positioned at both ends of the combustion chamber 6. Accordingly, the combustion gas flowing into the exhaust passage 11 from the combustion chamber outlet 8 flows in the exhaust passage in the reverse direction of the mixed gas flowing in the combustion chamber 6, and is released to the atmosphere from the exhaust port 12. Therefore, the temperature of the combustion gas flowing in the exhaust passage 11 is higher as closer to the combustion chamber outlet 10, and lower as closer to the exhaust port 12. Accordingly, the temperature distribution of the catalyst in the combustion chamber 6 and the temperature distribution of combustion gas in the exhaust passage 11 are in reverse relation. Since the combustion chamber 8 is installed above the exhaust passage 11, the heat is fed back to the combustion gas, and the temperature distribution of the catalyst 8 may be uniform.

Other feature of the embodiment is explained below. That is, the upper part of the combustion chamber 8 contacts with the vaporizing chamber 16 as mentioned above, and hence the combustion temperature tends to be lower. By contrast, the lower part of the combustion chamber 6 contacts with the base through the exhaust passage 11, and hence the combustion temperature is likely to be maintained high. Therefore, when the mixed gas is supplied into the combustion chamber 6, the mixed gas flowing near the upper part of the combustion chamber 6 is small in the fluid resistance because the upper part of the combustion chamber is low in temperature, while the mixed gas flowing near the lower part of the combustion chamber 6 is large in the fluid resistance because the lower part of the combustion chamber is high in temperature. Accordingly, at the time of combustion, the mixed gas is likely to flow in the upper part of the combustion chamber, and by the synergistic effect of lowering tendency of the combustion temperature, the catalytic reaction by the catalyst is not done actively. On the other hand, the mixed gas is hard to flow in the lower part of the combustion chamber, and hence the mixed gas amount decreases, and the combustion decreases, so that the radiation heat from the lower part of the combustion chamber decreases, thereby making it difficult to compensate for temperature drop in the upper part of the combustion chamber.

In the embodiment, therefore, at the junction of the mixing device 5 and combustion chamber 6, the vicinity of the inlet of the combustion chamber 6 is bent nearly at right angle. Herein, integral forming of the gas flow velocity regulator in the embodiment and the combustion chamber of the invention corresponds to the combustion chamber 6 in the embodiment. Therefore, the junction of the gas flow velocity regulator and the combustion chamber cannot be distinguished apparently in this embodiment.

In such constitution, since the mixed gas flows along the wall of the mixing device 5, the velocity of flow in the route is proportional to the radius of curvature in the bending of the route, and hence the flow velocity of the mixed gas has a velocity distribution in the flow direction.

The flow velocity of the mixed gas is slowest near a bending 19 where the radius of curvature is smallest, and is fastest near a bending 20 where the radius of curvature is largest. Having this velocity distribution, the mixed gas flows into the combustion chamber. A stagnant region is formed and the flow is difficult in the upper part of the combustion chamber near the combustion chamber inlet where the radius of curvature is small, and a centrifugal force acts and the mixed gas flows smoothly in the lower part of the combustion chamber near the combustion chamber inlet where the radius of curvature is large. Accordingly, while not in combustion, the mixed gas flow rate is smaller in the upper part of the combustion chamber 6 and larger in the lower part of the combustion chamber 6.

Therefore, in the embodiment, the difference in flow resistance in the combustion chamber 6 between combustion and non-combustion is canceled, and the velocity components of the mixed gas in the vertical direction of the portion of catalytic reaction by catalyst are substantially uniform, and the mixed gas undergoes catalytic combustion uniformly in the combustion chamber 6. Hence, the difference in combustion distribution in the vertical direction of the combustion chamber decreases, and stable combustion is realized.

In the embodiment, the vaporizing chamber is provided above the combustion chamber, but this is not limitative, and, for example, the vaporizing chamber may not be provided.

In the embodiment, the configuration of the combustion chamber and mixing device is substantially at right angle approximately, but not limited to this, for example, the relation with the mixing device may be other than right angle as far as it is adjusted so that the flow velocity distribution of the mixed gas may be substantially uniform at least in the vertical direction in the combustion chamber at the time of catalytic combustion.

In the embodiment, the inlet portion of the combustion chamber is bent so that the flow velocity distribution of mixed gas may be substantially uniform, at least in the vertical direction in the combustion chamber, at the time of catalytic combustion, but not limited to this, for example, the junction with the combustion chamber at the mixing device may be bent, or the gas flow velocity regulator for adjusting the flow velocity distribution of mixed gas to be substantially uniform, at least in the vertical direction in the combustion chamber, at the time of catalytic combustion may be installed independently, between the combustion chamber and mixing device.

In the embodiment, moreover, a special attention is paid to the shape of the inlet portion of the combustion chamber, so that the flow velocity distribution of the mixed gas may be substantially uniform, at least in the vertical direction in the combustion chamber, at the time of catalytic combustion, but not limited to this, for example, paying attention to the nozzle portion, the injection speed itself of the fuel gas may be adjusted.

(Embodiment 2)

Figure 4:
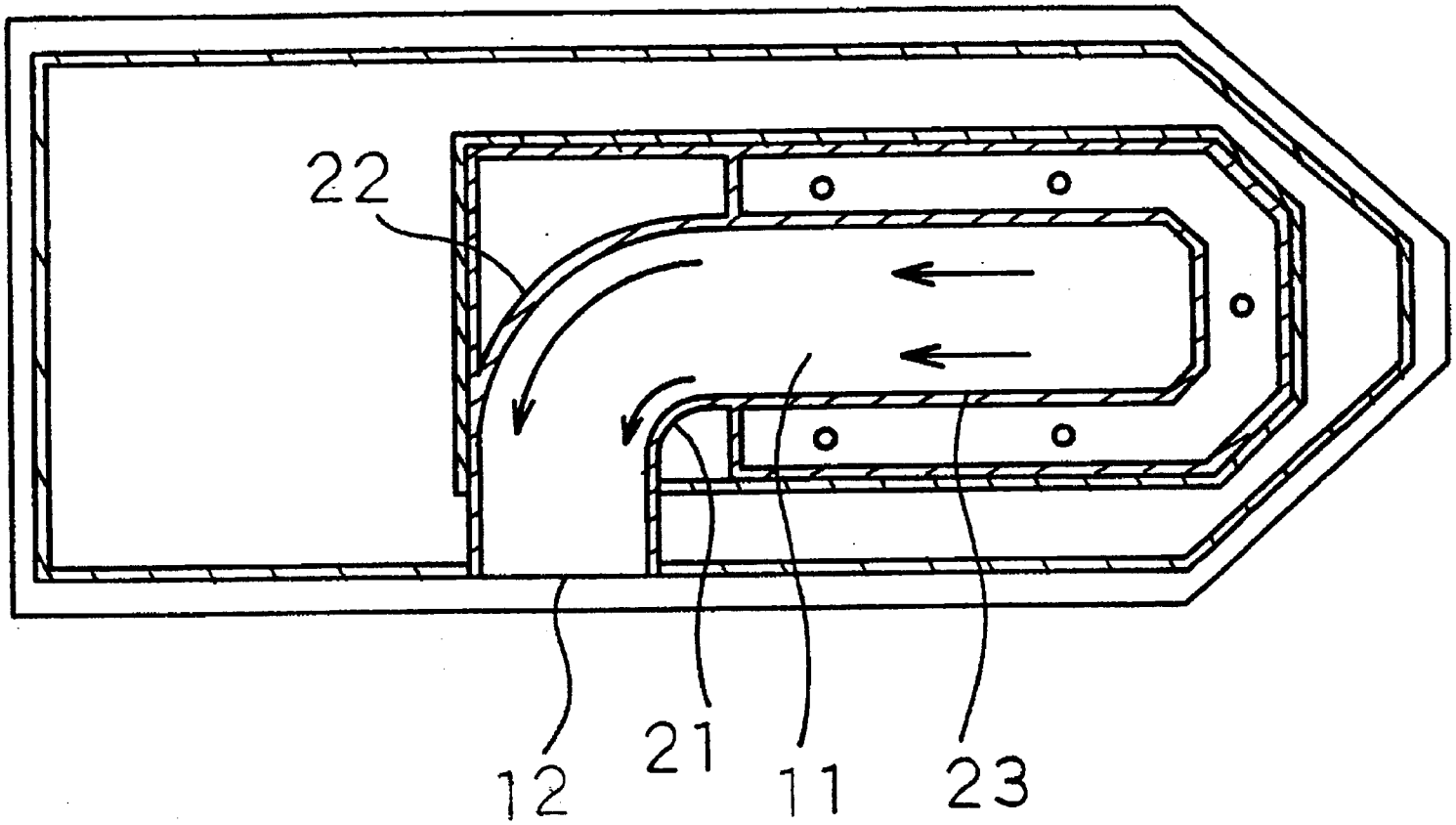
FIG. 4 is a horizontal sectional view of a catalytic combustion iron according to other embodiment of the invention (corresponding to a 4—4 line sectional view in FIG. 1).
Figure 5:
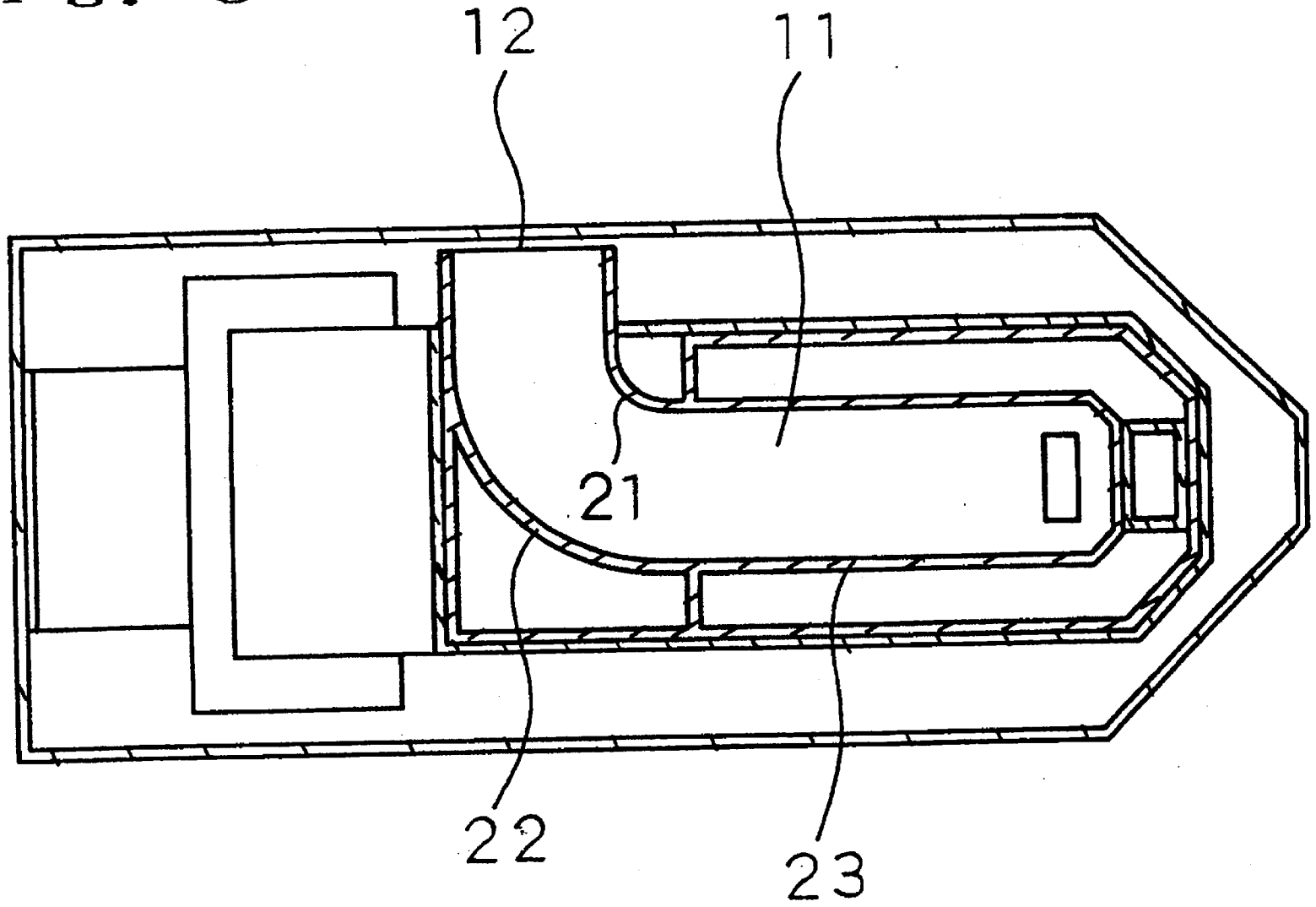
FIG. 5 is a horizontal sectional view of a catalytic combustion iron according to a different embodiment of the invention (corresponding to a 5—5 line sectional view in FIG. 1).

Other embodiment of the invention is described below while referring to FIGS. 1, 4 and 5. Herein, FIG. 4 is a 4—4 line sectional view in FIG. 1, and FIG. 5 is a 5—5 line sectional view in FIG. 1.

In the constitution of the catalytic combustion iron operating as described above, if the ignition device 9 misfires due to some accident when starting up, and flame is not formed in the combustion chamber 6, the catalyst temperature does not reach up to the active temperature, and unburnt fuel gas is discharged from the exhaust port 12, of which case is explained below.

That is, the fuel gas injected from the nozzle aspirates the surrounding air by the induction action of the gas flow, and is mixed uniformly in the mixing device, and supplied into the combustion chamber. The mixed gas supplied into the combustion chamber flows in the combustion chamber, passes through the exhaust passage, and is released to the atmosphere through the exhaust port. If unburnt mixed gas is discharged from the exhaust port due to misfiring or the like, if ignited by a lighter or the like at the exhaust port, the flame may set on the exhaust port.

Generally, the velocity of a flame propagating in a premixed gas is called combustion speed, and it varies with the kind and concentration of fuel, and at atmospheric pressure and room temperature, it is said to be 45 cm/s (fuel concentration 4.6%) in propane, and 44 cm/s (fuel concentration 3.5%) in butane. Therefore, by setting the sectional area of the exhaust passage so that the mixed gas flow velocity may be sufficiently larger than the combustion speed, if a lighter is brought closer to the exhaust port, the flame is blown away, not setting on the exhaust port.

In spite of this, however, when the ambient temperature drops, the gas pressure in the fuel tank declines, or the residual gas in the fuel tank decreases, the injection gas amount from the nozzle decreases, the mixed gas flow velocity drops, and there is also a risk of flame setting on the exhaust port.

In the embodiment, therefore the exhaust passage 11 is provided so as to have the passage sectional area so that the mixed gas flow velocity flowing in the exhaust passage 11 may be slower than the combustion speed of the mixed gas. When butane is used as fuel gas, for example, the combustion speed at room temperature and atmospheric pressure is 44 cm/s (fuel concentration 3.5%). Therefore, in the case of catalytic combustion iron with rated combustion amount of 500 kcal/h, the flow velocity of the mixed gas is 137 cc/s. Therefore, in order that the mixed gas flow velocity be smaller than the combustion speed, seeing 137 (cc/s)/44 (cm/s)=311 $mm^2$, the sectional area of the exhaust passage 11 should be 330 $mm^2$ or more by considering a certain margin.

That is, when the sectional area of the exhaust passage 11 is wider than the area above, the combustion speed is faster than the mixed gas flow velocity flowing in the exhaust passage 11.

In such circumstance, if there is a flame in the exhaust passage 11, the force of transfer of flame to the supply source side of the fuel gas becomes stronger than the force of the flame being pushed by the flow of the mixed gas, and the flame is propagated to the upstream, overcoming the flow of the mixed gas in the exhaust passage 11, or so-called backfire phenomenon occurs.

If, therefore, a flame of a lighter or the like is brought closer to the exhaust port 12, as soon as the mixed gas injected from the exhaust port 12 is ignited, the flame is aspirated from the exhaust port 12, and propagates in the exhaust passage 11, and reaches up to the combustion chamber outlet 10. Herein, the flame sets on the combustion chamber outlet 10. This flame heats the combustion chamber 6.

In this way, when the combustion chamber 6 is heated to high temperature, the temperature of the catalyst 8 installed in the combustion chamber 6 also climbs up. When the temperature of the catalyst 8 exceeds the active temperature of the catalyst, the mixed gas begins to undergo catalytic combustion by the catalytic reaction on the surface of the catalyst 8.

When catalytic combustion begins on the catalyst 8, only combustion gas is supplied to the combustion chamber outlet 10, and fuel gas is not supplied, and therefore the flame depositing on the combustion chamber outlet 10 is extinguished. As a result, same as when ignited normally by the ignition device 9, the catalytic combustion iron starts.

In the embodiment, thus, if unburnt gas (mixed gas) is ignited by a flame of a lighter or the like from the exhaust port 12 due to misfiring, same as in the case of normal ignition, the transfer is normal from flame combustion to catalytic combustion, so that safety against abnormal use is notably enhanced.

(Embodiment 3)

A different embodiment of the invention is described below while referring to FIGS. 4 and 5.

As shown in FIGS. 4 and 5, a bending is formed so as to alter the flow direction of combustion gas or mixed gas nearly at right angle near the exhaust port 11 of the exhaust passage 11. The bending of the exhaust passage 11 comprises a small bending 21 in the radius of curvature and a large bending 22 in the radius of curvature.

The mixed gas flows along the wall of the exhaust passage 11, and in the linear portion 23 of the passage shape, the flow velocity of mixed gas is almost uniform in the flow direction. In the bending, however, the flow velocity flowing in the passage is proportional to the radius of curvature, and hence the flow velocity of the mixed gas comes to have a velocity distribution in the flow direction.

Accordingly, the flow velocity of the mixed gas is slowest near the smallest bending 2 in the radius of curvature; and fastest near the largest bending 23 in the radius of curvature. Keeping this velocity distribution, the mixed gas is released to the atmosphere through the exhaust port 12. Hence, near the exhaust port 12, the mixed gas comes to have the above velocity distribution. These bending parts are formed so that the flow velocity near the bending 21 and at the exhaust port 12 in its vicinity may be slower than the combustion speed of the mixed gas.

At this time, if a flame of a lighter or the like is brought closer to the exhaust port 12, the flame ignited on the unburnt gas propagates in the slow flow velocity region flowing along the bending 21, and gets into the exhaust passage 11 from the exhaust port 12, and further propagates in the exhaust passage 11, thereby reaching up to the combustion chamber outlet 10.

It is herein basically the same as in the foregoing embodiment that the sectional area of the exhaust passage of the upstream side of the bending 21 is set wider than the specified area so that the flow velocity of the mixed gas flowing therein may be slower than the combustion speed of the mixed gas.

The flame thus reaching up to the combustion chamber outlet 10 deposits on the combustion chamber outlet 10. This flame heats the combustion chamber 6. When the temperature of the combustion chamber 6 becomes high, the temperature of the catalyst 8 placed in the combustion chamber 6 also climbs up. When the temperature of the catalyst 8 exceeds the active temperature of catalyst, the mixed gas burns by catalytic reaction on the surface of the catalyst 8. When catalytic combustion begins on the catalyst 8, only combustion gas is supplied to the combustion chamber outlet 10, and fuel gas is not supplied, so that the flame depositing on the combustion chamber outlet 10 is extinguished. As a result, same as when ignited normally by the ignition device 9, the catalytic combustion iron starts. Hence, safety against abnormal use is notably enhanced.

(Embodiment 4)

A further different embodiment of the invention is described by reference to FIG. 6.

Figure 6:
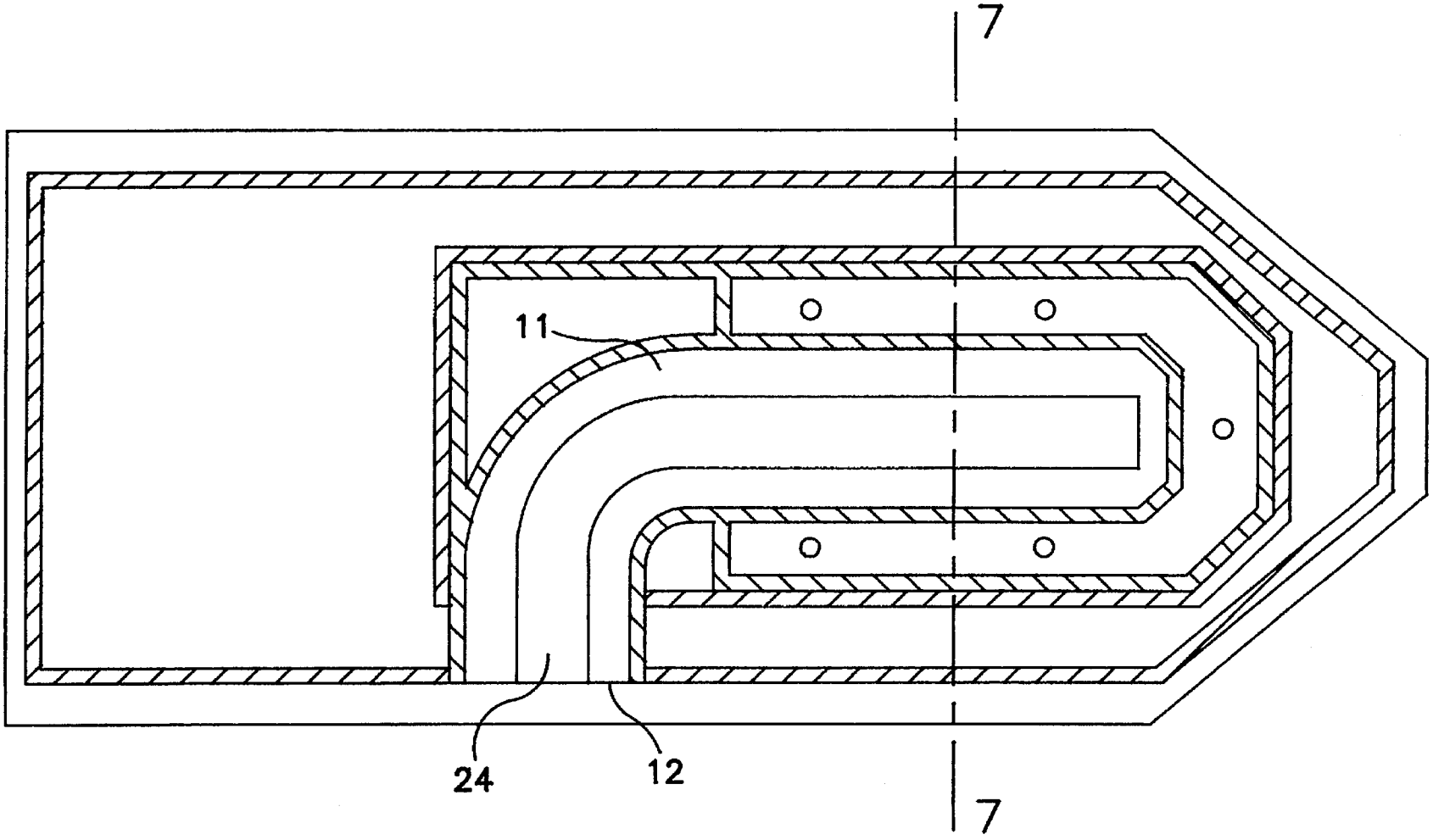
FIG. 6 is a horizontal sectional view of a catalytic combustion iron according to a different embodiment of the invention (corresponding to a 4—4 line sectional view in FIG. 1).

FIG. 6 is a 4—4 line sectional view in FIG. 1.

A main difference of this embodiment from the foregoing embodiments is that, as shown in the drawing, a groove 24 is provided in the exhaust passage 11 nearly in its middle, from the exhaust port 12 to the vicinity of the combustion chamber outlet.

Figure 7:
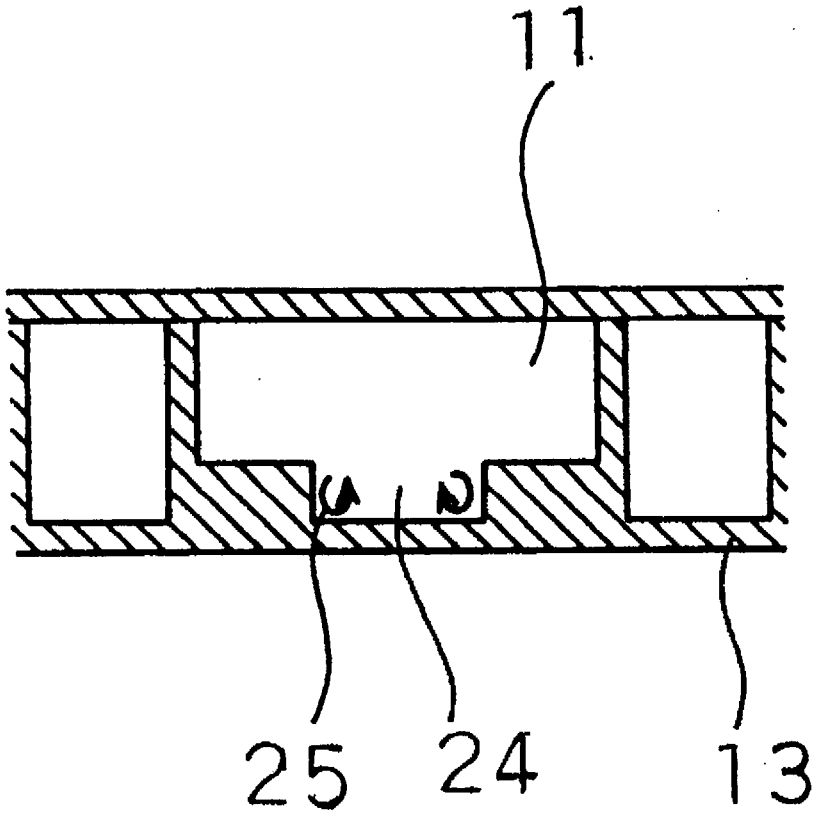
FIG. 7 is a vertical sectional magnified view of an exhaust passage in a catalytic combustion iron according to a different embodiment of the invention (corresponding to an 7—7 line sectional view in FIG. 6).

That is, the flow velocity of the mixed gas flowing above the groove 24 from the groove 2 is slower than in other locations. Moreover, as shown in FIG. 7 which is an FF line sectional view in FIG. 6 of the exhaust passage 11, when the groove 24 is provided in the exhaust passage 11, a vortex 25 is formed in the groove 24 when the mixed gas flows in the exhaust passage. This vortex 25 is formed in the entire groove 24, and it improves the flame propagation property very well.

Therefore, if a flame of a lighter or the like is brought closer to the exhaust port 12, the flame ignited on the unburnt gas propagates immediately in the exhaust passage 11 along the groove 24, and reaches the combustion chamber outlet 10. Herein, the flame deposits on the combustion chamber outlet 10. This flame heats the combustion chamber 6. When the temperature of the combustion chamber 6 becomes high, the temperature of the catalyst 8 placed in the combustion chamber 6 also elevates. When the temperature of the catalyst 8 exceeds the active temperature of catalyst, the mixed gas burns by catalytic reaction on the surface of the catalyst 8. When catalytic combustion starts on the catalyst 8, only combustion gas is supplied in the combustion chamber outlet 10, and fuel gas is not supplied, so that the flame depositing on the combustion chamber outlet 19 is extinguished. As a result, same as in the case of normal ignition by the ignition device 9, the catalytic combustion iron starts. Thus, the safety against abnormal use is notably enhanced.

(Embodiment 5)

A still different embodiment of the invention is described below while referring to FIG. 8.

Figure 8:
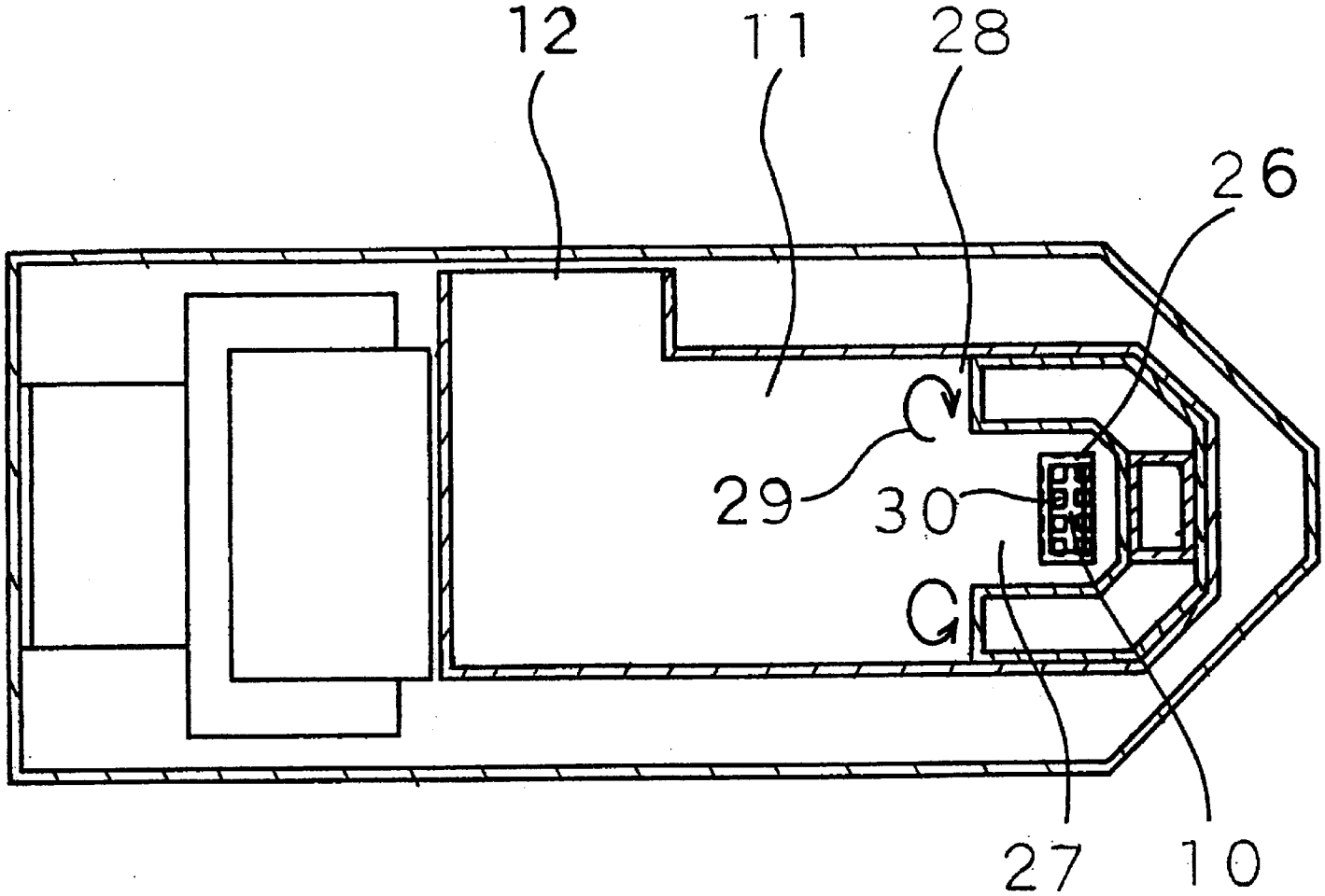
FIG. 8 is a horizontal sectional view of a catalytic combustion iron according to a different embodiment of the invention (corresponding to a 5—5 line sectional view in FIG. 1).

FIG. 8 is a 5—5 line sectional view in FIG. 1.

A principal difference of the embodiment from the preceding embodiment is, as shown in the drawing, that a flame retaining plate 26 having multiple pores is provided at the combustion chamber outlet 19, in which the passage sectional area of an exhaust passage 27 near the flame retaining plate 26 is set smaller than the passage sectional area of its downstream exhaust passage 11. Meanwhile, the passage sectional area of the exhaust passage 11 is set wider than a specified area so that the flow velocity of the mixed gas may be slower than the combustion speed of the mixed gas.

In such constitution, a vortex 29 is formed in a place 28 where the passage sectional area increases suddenly. If a flame of a lighter or the like is brought closer to the exhaust port 12, the flame igniting on the unburnt gas immediately propagates in the exhaust passage 11 to reach up to the combustion chamber outlet 10. Herein, the flame deposits on the flame retaining plate 26 provided in the combustion chamber outlet 10.

Since multiple pores are formed in the flame retaining plate 26, many tiny vortices are formed on the surface of the flame retaining plate 26 when the mixed gas flows. These vortices act very effectively for retaining the flame. Hence the flame firmly deposits on the flame retaining plate 26. Furthermore, by the vortices 29 generated in the expanding area 28, the stability of the flame is increased. Accordingly, the flame once aspirated from the exhaust port 12 to the upstream side does not flow again toward the exhaust port 10. Thus, the safety against abnormal use is further promoted.

By this flame, the combustion chamber 6 is heated. When the temperature of the combustion chamber 6 becomes high, the temperature of the catalyst 8 installed in the combustion chamber 6 also climbs up. As the temperature of the catalyst 8 exceeds the active temperature of catalyst, the mixed gas burns by catalytic reaction on the surface of the catalyst 8. When catalytic combustion of the catalyst 8 begins, only combustion gas is supplied into the combustion chamber outlet 19, and fuel gas is not supplied, and therefore the flame depositing on the combustion chamber outlet 10 is extinguished. As a result, same as when ignited normally by the ignition device 9, the catalytic combustion iron starts.

(Embodiment 6)

A further different embodiment of the invention is explained by reference to FIG. 9.

Figure 9:
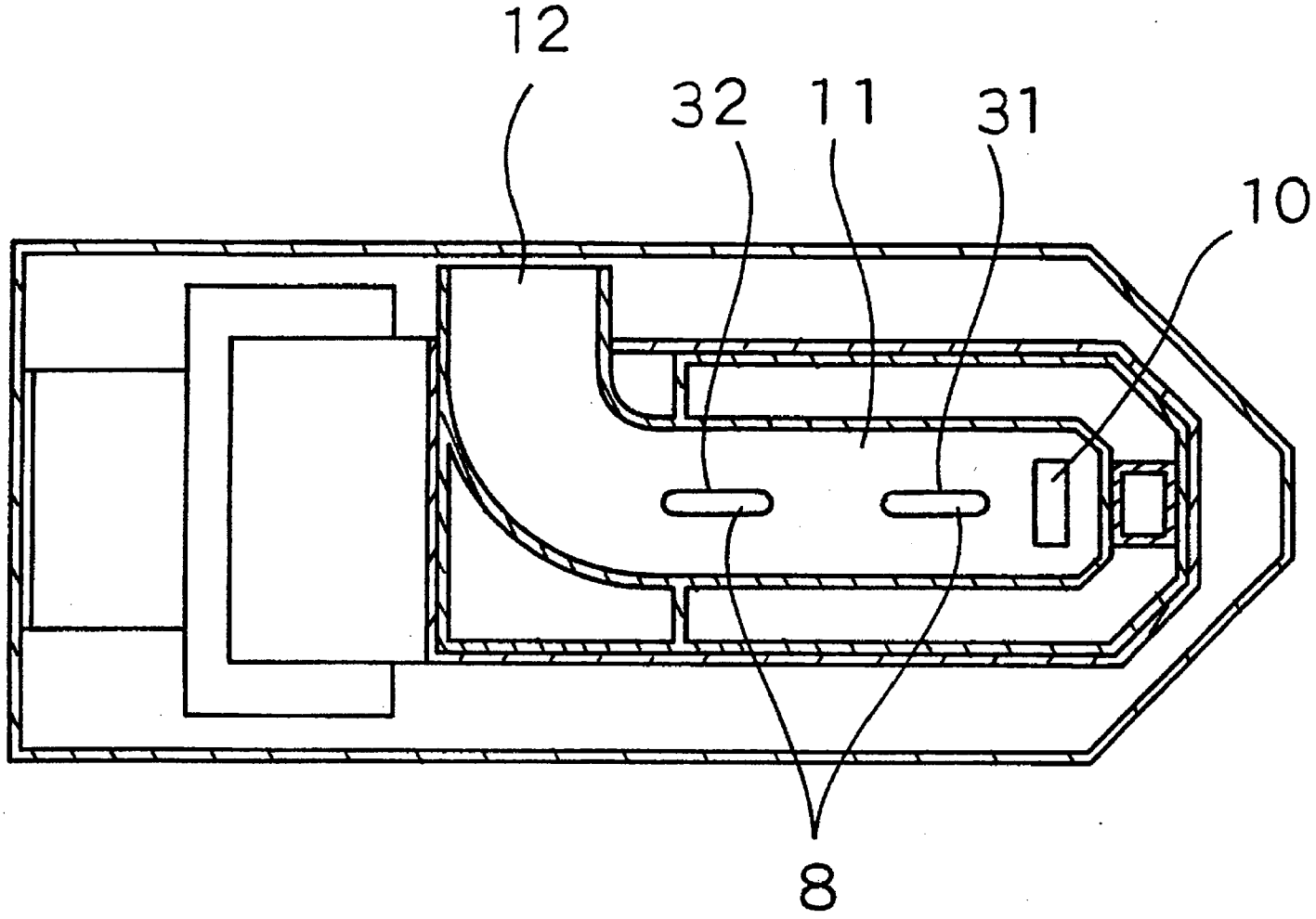
FIG. 9 is a horizontal sectional view of a catalytic combustion iron according to a different embodiment of the invention (corresponding to a 5—5 line sectional view in FIG. 1).

FIG. 9 is a 5—5 line sectional view in FIG. 1. The exhaust passage 11 is partitioned into its upper wall and combustion chamber 6. This upper wall corresponds to the partition in the invention.

A main difference of the embodiment from the foregoing embodiments is, as shown in the drawing, that communication holes 31, 32 with the combustion chamber 6 are pierced in the upper wall of the exhaust passage 11, in which the catalyst 8 is installed in the combustion chamber 6 so as to close the communication holes 31, 32 with the catalyst 8 installed in the combustion chamber 6, thereby preventing the mixed gas from passing through the communication holes 31, 32.

Hence, if the unburnt gas is ignited by bringing a flame of a lighter or the like closer to the exhaust port 12, the flame immediately propagates through the exhaust passage 11 to reach the combustion chamber outlet 10, thereby depositing on the combustion chamber outlet 10.

Figure 10:
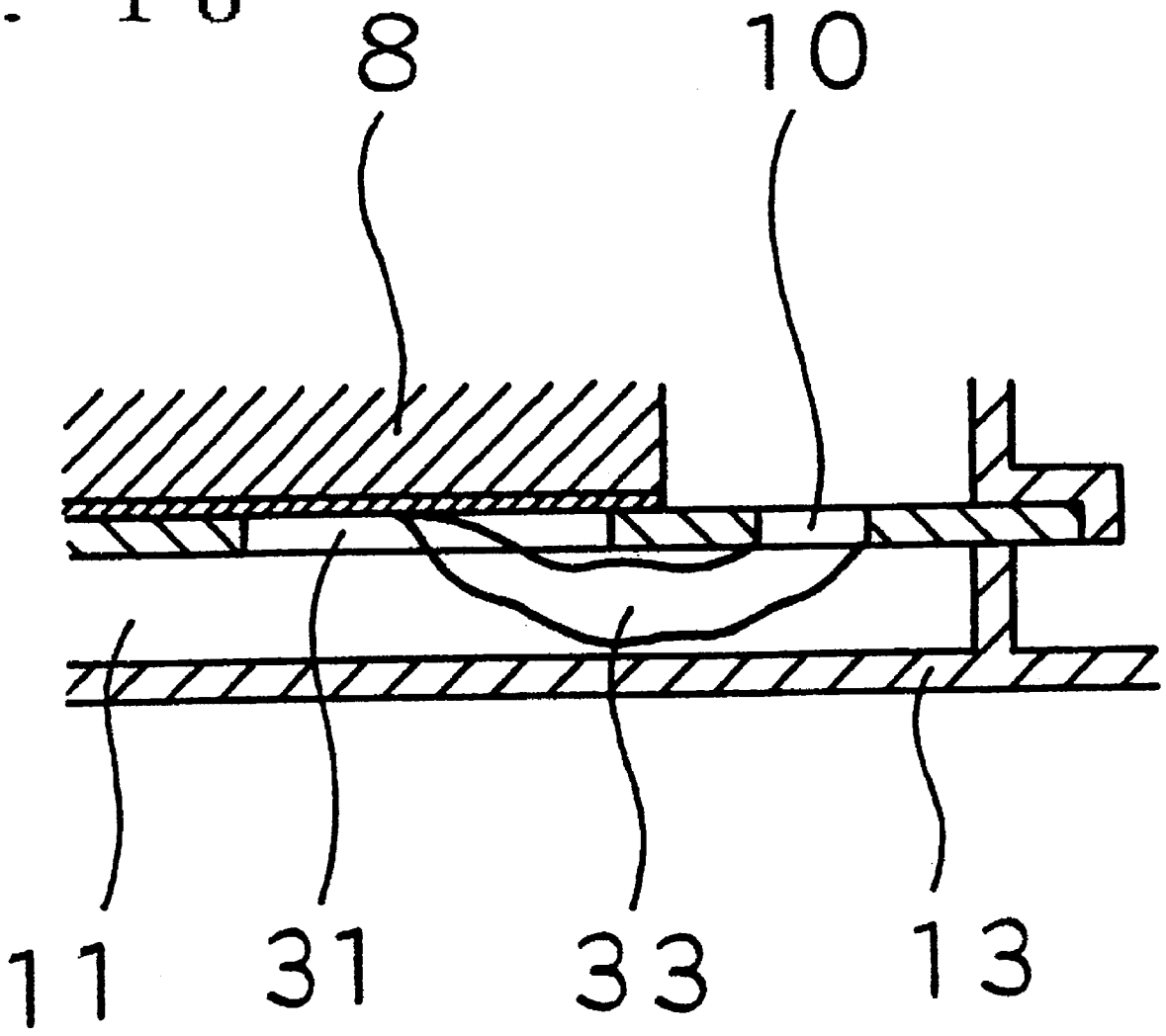
FIG. 10 is a vertical sectional magnified view of an exhaust passage in a catalytic combustion iron according to a different embodiment of the invention (corresponding to a magnified view 10 in FIG. 1).

The mode at this time is shown in FIG. 10. FIG. 10 is a magnified view 10 in FIG. 1.

In the embodiment, the depositing flame 33 directly heats the catalyst 8 through the communication hole 31, or high temperature combustion gas heats the catalyst 8 through the communication hole 32. When the temperature of the catalyst 8 exceeds the active temperature of catalyst, the mixed gas burns by catalytic reaction on the surface of the catalyst 8. When catalytic combustion begins on the catalyst 8, only combustion gas is supplied to the combustion chamber outlet 10, and fuel gas is not supplied, so that the flame depositing on the combustion chamber outlet 10 is extinguished.

Accordingly, as compared with the prior art in which the flame heats the wall of the exhaust passage 11, its heat is transmitted to the combustion chamber 6, the heat of the combustion chamber 6 is transmitted to the catalyst 8, and the catalyst 8 is heated, and the catalyst temperature is raised to the active temperature, in the invention, the catalyst 8 is directly heated by the flame depositing on the combustion chamber outlet 10, so that transfer from flame combustion to catalytic combustion can be done in a short time.

Therefore, if a flame of a light or the like is brought closer to the exhaust port 12, and the mixed gas is ignited, the flame is aspirated from the exhaust port 12, and moreover the aspirated flame directly heats the catalyst 8 installed in the combustion chamber 6, so that transfer from flame combustion to catalytic combustion is smooth, and the flame ignited by the lighter or the like is extinguished in a short time. As a result, same as when ignited normally by the ignition device 9, the catalytic combustion iron starts. Hence, the safety against abnormal use is extremely enhanced.

(Embodiment 7)

Figure 11:
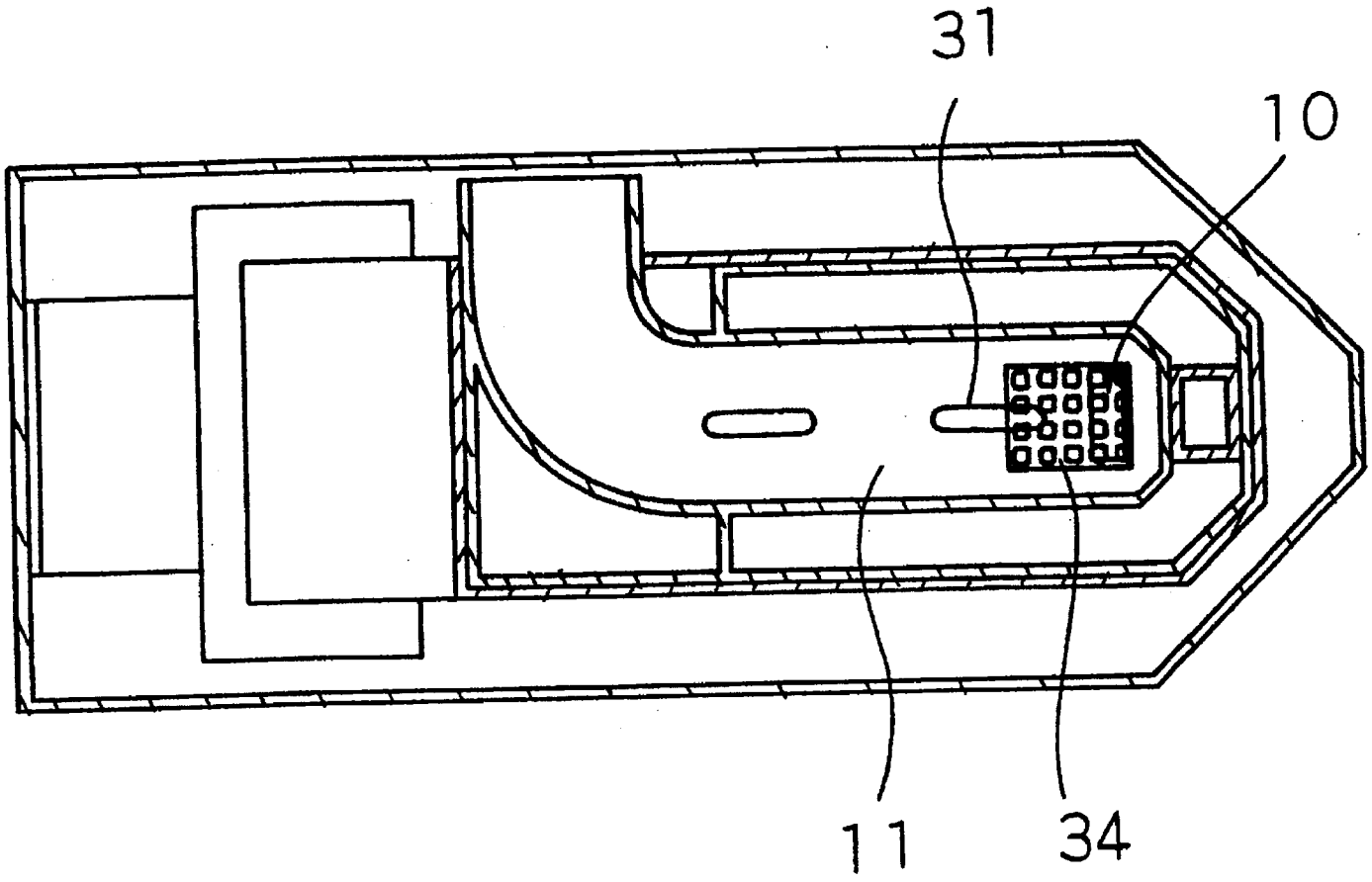
FIG. 11 is a horizontal sectional view of a catalytic combustion iron according to a different embodiment of the invention (corresponding to a 5—5 line sectional view in FIG. 1).
Figure 12:
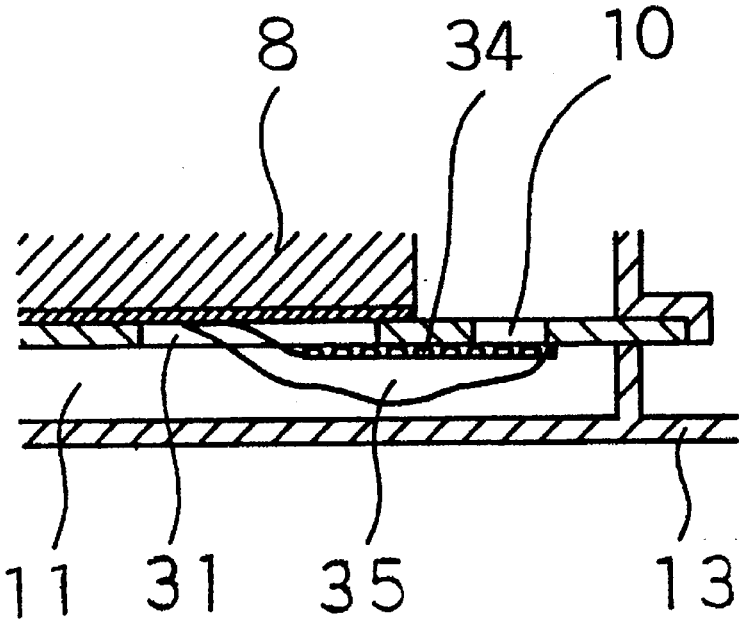
FIG. 12 is a vertical sectional magnified view of an exhaust passage in a catalytic combustion iron according to a different embodiment of the invention (corresponding to a magnified view 10 in FIG. 1).

A different embodiment of the invention is further described by referring to FIGS. 11 and 12.

A main difference of the embodiment from the other embodiments is, as shown in the drawing, that a flame retaining plate 34 having multiple pores is provided at the combustion chamber outlet 10, and that the flame retaining plate 34 is extended nearly to the communication hole 31 along the wall of the exhaust passage 11.

In this manner, as shown in FIG. 12, a flame 35 depositing on the flame retaining plate 34 on the combustion chamber outlet 10 is extended along the flame retaining plate 34. This is because multiple vortices are generated on the pores pierced in the flame retaining plate 34 and these vortices are very effective for retaining the flame 35, so that the flame is formed along the flame retaining plate 34. Therefore, the flame 35 securely reaches the communication hole 31, and the catalyst 8 is heated directly by the flame 35, and transfer from flame combustion to catalytic combustion is done in a much shorter time. As a result, the safety against abnormal use is extremely promoted.

(Embodiment 8)

Figure 13:
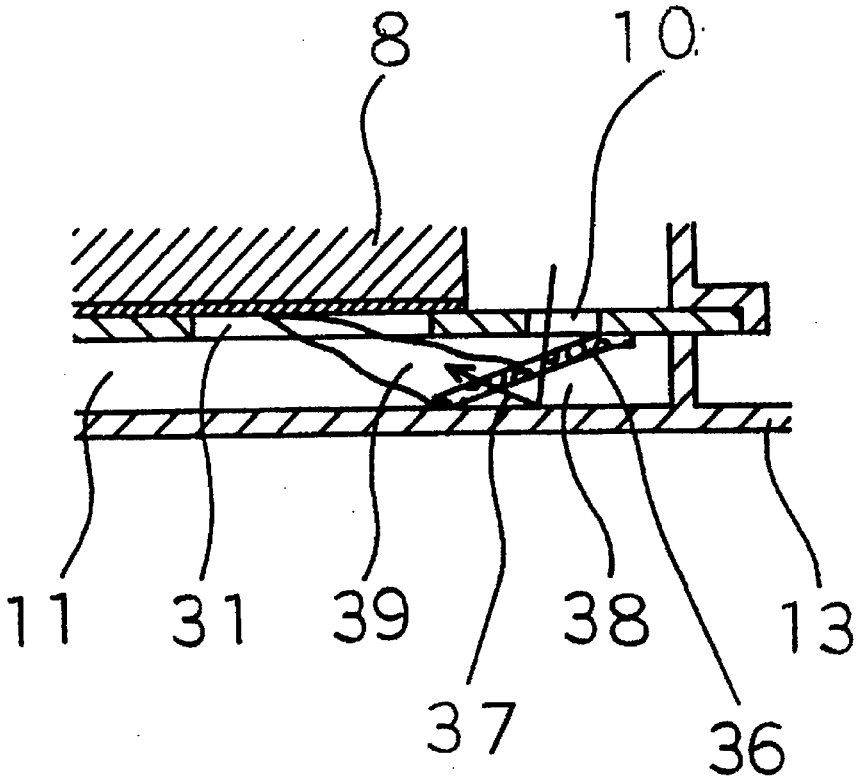
FIG. 13 is a vertical sectional magnified view of an exhaust passage in a catalytic combustion iron according to a different embodiment of the invention (corresponding to a magnified view 10 in FIG. 1).

A still further embodiment of the invention is described by reference to FIG. 13.

A main difference of the embodiment from the other embodiments is, as shown in the drawing, that a flame retaining plate 38 is provided obliquely to the exhaust passage 11, in which a mixed gas 37 passes through the flame retaining plate 36, collides against the wall of the exhaust passage, and passes through the flame retaining plate 36 again.

In such constitution, there is a stagnant region in the flow accompanied by vortices in a region 38 between the flame retaining plate 36 and the wall. Accordingly, the flame retaining property on the flame retaining plate 36 is notably improved. What is more, a flame 39 depositing on the flame retaining plate 36 is an inclined flame to the exhaust passage because the flame retaining plate 36 is provided obliquely to the exhaust passage 11. Therefore, the flame 39 securely reaches the communication hole 31, and heating of the catalyst 8 by the flame 39 is more satisfactory, and transfer from flame combustion to catalytic combustion can be done in a much shorter time. Hence, the safety against abnormal use is extremely enhanced.

In the embodiments, the exhaust passage is bent nearly at right angle near the exhaust port, but not limited to this, for example, it may be formed straightly, and in short the shape is not particularly defined as far as the passage sectional area of the exhaust passage is set wider than the specified area so that the flow velocity of all or part of mixed gas, of the mixed gas flowing in the exhaust passage, may be slower than the combustion speed of the mixed gas.

In part of the exhaust passage from the exhaust port to the upstream side opening, if the sectional area of the exhaust passage in that portion does not satisfy the relation that the flow velocity of mixed gas is slower than the combustion speed of the mixed gas, it is enough as far as the passage area is adjusted so that the flame generated at the exhaust port may substantially propagate to the upstream side opening.

In the embodiment, the groove 24*g* is provided nearly in the middle of the exhaust passage 11, but not limited to this, for example, it may be provided along the bending of the exhaust passage, and the forming place is not particularly defined.

Also in the embodiment, there is a bending in the exhaust passage 11, but not limited to this, the exhaust passage may be formed straightly without having bending substantially.

In the foregoing embodiments, when the mixed gas is ignited at the exhaust port, the flame is aspirated from the exhaust port and it is transferred to catalytic combustion by making use of the flame, but not limited to this, for example, the passage sectional area for satisfying the specified relation between the flow velocity of mixed gas and combustion speed of mixed gas may be adjusted only to an intermediate position to the upstream side of the exhaust passage, or the groove may be formed only to an intermediate point of the exhaust passage. That is, in such cases, once ignited on the mixed gas at the exhaust port, so far as the flame is not blown out from the exhaust port to the outside, the flame may be either held or extinguished in the middle of the exhaust passage.

From the viewpoint that the flow velocity of the mixed gas flowing at the exhaust port or substantially near the exhaust port may not be abnormal combustion speed of the mixed gas, particular attention has been paid to the structure of the exhaust passage near the exhaust port, but not limited to this, for example, the specified relation of the flow velocity of mixed gas and combustion speed of mixed gas may be satisfied by adjusting the feed volume of fuel gas by paying attention to the fuel feed means, or considering the structure of the combustion chamber, or combining them.

Moreover, in the foregoing embodiments, a special attention has been paid to the structure of the exhaust passage from the viewpoint that the flow velocity of mixed gas may be slower than the combustion speed of mixed gas in the substantially continuous passage from the exhaust port of all or part of the mixed gas, of the mixed gas flowing in the exhaust passage, to the upstream side opening, but not limited to this, for example, the specified relation between the flow velocity of the mixed gas and combustion speed of the mixed gas may be satisfied by adjusting the feed volume of fuel gas by paying attention to the fuel feed means, or considering the structure of the combustion chamber, or combining them.

As clear from the description herein, the invention has a benefit that the stability of the catalytic combustion may be further enhanced from the level of the prior art. Still more, as compared with the prior art, the catalytic combustion iron further excelling in safety can be presented.

What is claimed is:

1. A catalytic combustion iron comprising a fuel tank for storing liquefied fuel gas, a nozzle for vaporizing and injecting liquefied gas in the fuel tank, a mixing device for mixing the fuel gas injected from the nozzle and air, a combustion chamber for holding a catalyst and burning the mixed gas catalytically by using the catalyst, a base brought into contact with an object to be heated, and an exhaust passage formed between an exhaust port for exhausting combustion gas outside and an outlet of the combustion chamber, wherein the exhaust passage is mounted above the base, and the combustion chamber is mounted above the exhaust passage.

2. A catalytic combustion iron of claim 1, further comprising a water tank for storing water for generating steam, and a vaporizing chamber for generating steam by vaporizing the water supplied from the water tank by the combustion heat generated by the catalyst, wherein the base has steam pores for injecting the steam generated in the vaporizing chamber in the bottom surface, and the vaporizing chamber is mounted on the combustion chamber.

3. A catalytic combustion iron of claim 2, wherein the combustion gas is generated catalytically, and the combustion chamber and the exhaust passage are coupled so that the direction of the combustion gas flowing in the exhaust passage is substantially reverse to the direction of the mixed gas flowing in the combustion chamber.

4. A catalytic combustion iron of claim 2, wherein a gas flow velocity regulator is provided between the mixing device and an inlet of the combustion chamber for adjusting flow velocity distribution of the mixed gas to be substantially uniform, at least in the vertical direction in the combustion chamber for catalytic combustion.

5. A catalytic combustion iron of claim 4, wherein the mixing device and the combustion chamber are coupled so that the configuration may be substantially orthogonal.

6. A catalytic combustion iron of claim 2, wherein all or part of the mixed gas flowing in the exhaust passage is substantially continuously formed from the exhaust port to the outlet of the combustion chamber at the upstream side, and all or part of the continuously formed mixed gas has a flow velocity which is slower than a combustion speed of the mixed gas.

7. A catalytic combustion iron of claim 6, wherein a passage sectional area of the exhaust passage is set wider than a specific area so that the flow velocity of the continuously formed mixed gas may be slower than the combustion speed of the mixed gas.

8. A catalytic combustion iron of claim 6, wherein a groove is formed from the exhaust port to the upstream side in the exhaust port so that the flow velocity of the continuously formed mixed gas may be slower than the combustion speed of the mixed gas.

9. A catalytic combustion iron of claim 6, wherein a bending is formed in the exhaust passage near the exhaust port, and this bending is formed so that the flow velocity of the mixed gas at least in the vicinity of the bending may be slower than the combustion speed of the mixed gas.

10. A catalytic combustion iron of claim 6, wherein a flame retaining plate having multiple tiny pores is provided at the outlet of the combustion chamber, and a passage sectional area of the exhaust passage near the flame retaining plate is set smaller than the passage sectional area of the downstream side of the exhaust passage.

11. A catalytic combustion pan iron of claim 6, wherein all or part of the side wall of the exhaust passage is formed as partition between the exhaust passage and the combustion chamber, and a communication hole that can be shielded by the portion held along the partition of the catalyst is provided in the partition.

12. A catalytic combustion iron of claim 11, wherein a flame retaining plate having multiple tiny pores is provided at the outlet of the combustion chamber, and this flame retaining plate is extended nearly to the communication hole along the wall of the exhaust passage.

13. A catalytic combustion iron of claim 11, wherein a flame retaining plate having multiple tiny pores is provided near the outlet of the combustion chamber in the exhaust passage, and the flame retaining plate is installed at such an angle that the mixed gas once passes through the flame retaining plate, and collides against the wall of the exhaust passage, and passes through the flame retaining plate again, so that the flame on the flame retaining plate may contact with the catalyst which shields the communication hole.

14. A catalytic combustion iron of claim 1, wherein the combustion gas is generated catalytically, and the combustion chamber and the exhaust passage are coupled so that the direction of the combustion gas flowing in the exhaust passage is substantially reverse to the direction of the mixed gas flowing in the combustion chamber.

15. A catalytic combustion iron of claim 1, wherein a gas flow velocity regulator is provided between the mixing device and an inlet of the combustion chamber for adjusting flow velocity distribution of the mixed gas to be substantially uniform, at least in the vertical direction in the combustion chamber for catalytic combustion.

16. A catalytic combustion iron of claim 15, wherein the mixing device and the combustion chamber are coupled so that the configuration may be substantially orthogonal.

17. A catalytic combustion iron of claim 1, wherein all or part of the mixed gas flowing in the exhaust passage is substantially continuously formed from the exhaust port to the outlet of the combustion chamber at the upstream side, and all or part of the continuously formed mixed gas has a flow velocity which is slower than a combustion speed of the mixed gas.

18. A catalytic combustion iron of claim 17, wherein a passage sectional area of the exhaust passage is set wider than a specific area so that the flow velocity of the continuously formed mixed gas may be slower than the combustion speed of the mixed gas.

19. A catalytic combustion iron of claim 17, wherein a groove is formed from the exhaust port to the upstream side in the exhaust port so that the flow velocity of the continuously formed mixed gas may be slower than the combustion speed of the mixed gas.

20. A catalytic combustion iron of claim 17, wherein a bending is formed in the exhaust passage near the exhaust port, and this bending is formed so that the flow velocity of the mixed gas at least in the vicinity of the bending may be slower than the combustion speed of the mixed gas.

21. A catalytic combustion iron of claim 17, wherein a flame retaining plate having multiple tiny pores is provided at the outlet of the combustion chamber, and a passage sectional area of the exhaust passage near the flame retaining plate is set smaller than the passage sectional area of the downstream side of the exhaust passage.

22. A catalytic combustion iron of claim 17, wherein all or part of the side wall of the exhaust passage is formed as partition between the exhaust passage and the combustion chamber, and a communication hole that can be shielded by the portion held along the partition of the catalyst is provided in the partition.

23. A catalytic combustion iron of claim 22, wherein a flame retaining plate having multiple tiny pores is provided at the outlet of the combustion chamber, and this flame retaining plate is extended nearly to the communication hole along the wall of the exhaust passage.

24. A catalytic combustion iron of claim 22, wherein a flame retaining plate having multiple tiny pores is provided near the outlet of the combustion chamber in the exhaust passage, and the flame retaining plate is installed at such an angle that the mixed gas once passes through the flame retaining plate, and collides against the wall of the exhaust passage, and passes through the flame retaining plate again, so that the flame on the flame retaining plate may contact with the catalyst which shields the communication hole.

* * * * *